US010092046B2

(12) United States Patent
Bumgarner

(10) Patent No.: US 10,092,046 B2
(45) Date of Patent: Oct. 9, 2018

(54) MUSCLE GLOVE

(71) Applicant: Robert Bumgarner, Danville, CA (US)

(72) Inventor: Robert Bumgarner, Danville, CA (US)

( * ) Notice: Subject to any disclaimer, the term of this patent is extended or adjusted under 35 U.S.C. 154(b) by 568 days.

(21) Appl. No.: 14/800,947

(22) Filed: Jul. 16, 2015

(65) Prior Publication Data

US 2017/0013897 A1 Jan. 19, 2017

(51) Int. Cl.
*A41D 19/015* (2006.01)

(52) U.S. Cl.
CPC ..... *A41D 19/01547* (2013.01)

(58) Field of Classification Search
USPC ..... 2/161.1
See application file for complete search history.

(56) References Cited

U.S. PATENT DOCUMENTS 2,258,999 A * 10/1941 Nunn ..... A63B 71/146 2/159
3,290,695 A * 12/1966 Burtoff ..... A41D 19/01517 2/161.8
3,421,160 A * 1/1969 Domenico ..... A63B 71/148 2/159
3,583,704 A * 6/1971 Callanan ..... A63B 71/148 473/205
4,329,741 A * 5/1982 Bach ..... A63B 71/146 2/161.2
5,604,934 A * 2/1997 Willett ..... A41D 19/01547 2/161.1
6,669,657 B1 * 12/2003 Ongwela ..... A61H 7/001 601/134
8,066,655 B2 * 11/2011 Prather ..... A41D 19/01588 2/16
2005/0183183 A1 * 8/2005 Ono ..... A41D 19/01523 2/161.1
2008/0078010 A1 * 4/2008 Micheloni ..... A63B 71/148 2/160
2008/0201822 A1 * 8/2008 Oshima ..... A41D 19/01547 2/161.3
2011/0252536 A1 * 10/2011 Hendon ..... A41D 19/01547 2/160
2013/0000006 A1 * 1/2013 Norton ..... A41F 1/06 2/16
2014/0121064 A1 5/2014 Newman

* cited by examiner

*Primary Examiner* — Richale Quinn
(74) *Attorney, Agent, or Firm* — Steven A. Nielsen

(57) ABSTRACT

A wrist hooking glove of various embodiments assists athletes in reaching and maintaining a false grip while performing ring exercises. A false grip is where a wrist is above a ring. A false grip is difficult to achieve and maintain but is needed to perform the iron cross and muscle up maneuvers. A disclosed embodiment includes a completion style wrist hooking glove comprising one or more protrusions 700 secured to the mid to upper palm edge or protrusion area 400 of a glove 300. The protrusions provide leverage upon a ring, such as an Olympic ring. The artful integration of the protrusions with the glove helps to dissipate hand strain during ring exercises. The disclosed embodiments do not damage existing rings and do not require modification of existing rings. The disclosed embodiments may be worn while performing other exercises unrelated to rings.

5 Claims, 6 Drawing Sheets

MUSCLE GLOVE

BACKGROUND OF THE INVENTION (1) Field of the Invention

The invention generally relates to exercise equipment. More particularly, the invention relates to means and methods of assisting an athlete to execute a false grip as needed in various gymnastic Olympic ring maneuvers such as the iron cross and the muscle up.

(2) Description of the Related Art

The known related art fails to anticipate or disclose the principles of the present invention.

In the related art, various gloves, wraps, or support systems attempt to provide support or padding at the palm area of the hand. Such systems may be useful for general gripping, but do nothing to assist in the execution of a false grip.

U.S. Published Patent Application 2014/0121064 by Newman does an excellent job describing the "false grip", the "muscle up" maneuver and the strain inflected upon joints and muscles from ring exercises. In order to provide a better grip upon a ring and dissipate hand pressure placed upon a ring, Newman discloses ring attachment pieces of arcuate shape that substantially match the shape of a selected exercise ring. The grip device of Newman screws on to an existing exercise ring to increase the surface area of the ring. While Newman provides an artful new shape for exercise rings, Newman requires drilling holes into existing exercise rings or otherwise destructively altering exercise rings. The Newman grip device renders exercise rings unfit for regulation use. Gym owners are loath to alter their expensive Olympic rings or otherwise alter their standard exercise rings.

With the growing popularity of cross-fit training, more amateur athletes or exercise enthusiasts have taken to Olympic rings as a form of exercise. A milestone metric or rite of passage includes execution of the muscle up maneuver which requires a mastery of the false grip. Execution of the false grip traditionally requires years of training and the endurance of acute pain in the wrist area just below the pinky side of the hand. The related art fails to mitigate the pain and/or skeletal damage inflicted upon the wrist area while executing a false grip on a regulation or normal exercise ring. In the related art, hours of false grip practice are required to avoid slipping off the rings. Thus, there is a need in the art for means of assisting aspiring athletes in executing a false grip without resorting to changing or damaging existing exercise rings.

BRIEF SUMMARY OF THE INVENTION

The present invention overcomes shortfalls in the related art by presenting an unobvious and unique combination and configuration of methods and components to provide a wrist hooking system to assist in execution of a false grip. Disclosed hooking system embodiments comprise: protruding support members from an integrated glove, outside palm traction from an integrated glove and a wedge/leverage piece from an integrated glove. In the disclosed embodiments, protruding hooking areas may be directly applied to a ring allowing the disclosed glove system to disperse weight applied to the ring upon the entire hand area, preventing trauma to the wrist area and mitigating slippage from the ring.

The disclosed hooking systems overcome shortfalls in the art by allowing execution of a false grip by athletes with less physical strength as compared to classical gymnasts who have honed their craft with years of training and stringent dietary discipline. Without the disclosed hooking systems, execution of a false grip requires an inordinate amount of forearm strength and an unusual strength to weight ratio. Moreover, without the disclosed hooking systems, even strong athletes have difficulty in not slipping off a ring while learning the false grip. The disclosed hooking systems overcome shortfalls in the related art by providing a hooking or frictional attachment to a ring by use of a various components integrated or incorporated in to a glove, with the glove or disclosed system sometimes referred to as a Muscle Glove.

The disclosed hooking systems overcome shortfalls in the related art by enabling less honed athletes the benefit of Olympic ring exercise without wrist pain and the hazards of slipping as found in the related art.

In general, the disclosed embodiments facilitate the false grip, which may be a hand position wherein the wrist is above the ring. In a false grip position, an athlete's body weight is transmitted through the wrists and hands into the ring. The disclosed external protrusions, implements or devices are integrated into a glove, and thus dissipate force throughout the gloved hand. Moreover, the disclosed external protrusions provide leverage to assist in hoisting an athlete into the false grip position. Leverage may be obtained as an exterior ring surface acts as a fulcrum to the disclosed external protrusions. The disclosed external protrusions may also act as a passive support system, resting upon the upward surfaces of a ring. Unlike the Newman grip device, the presently disclosed embodiments do not damage or alter existing rings. Disclosed embodiments may include specialized means of attachment and/or stitching patterns to more artfully and efficiently secure a protrusion or wedge upon or into a glove.

Disclosed embodiments include lever systems, protrusions, cylindrical protrusions and/or other implements located at or near protrusion areas. Protrusion areas may be located near or upon the lower or outer palm hand area, such protrusion areas may be upon or near the hypothenar muscles. The areas of protrusion may also be located upon, between or near the small joints of the little finger such as the carpometacarpal and/or metacarpophalangeal.

Disclosed embodiments overcome shortfalls in the art by providing a unique glove system that both assists in ring exercise and may be worn while performing exercises off the rings such as weight lifting, jump roping, rope climbs, pushups and other exercises. Disclosed embodiments provide leverage and traction around the outside palm area to better secure a false grip while using rings and to reduce hand strain.

These and other objects and advantages will be made apparent when considering the following detailed specification when taken in conjunction with the drawings.

REFERENCE NUMERALS IN THE DRAWINGS

Figure 1:
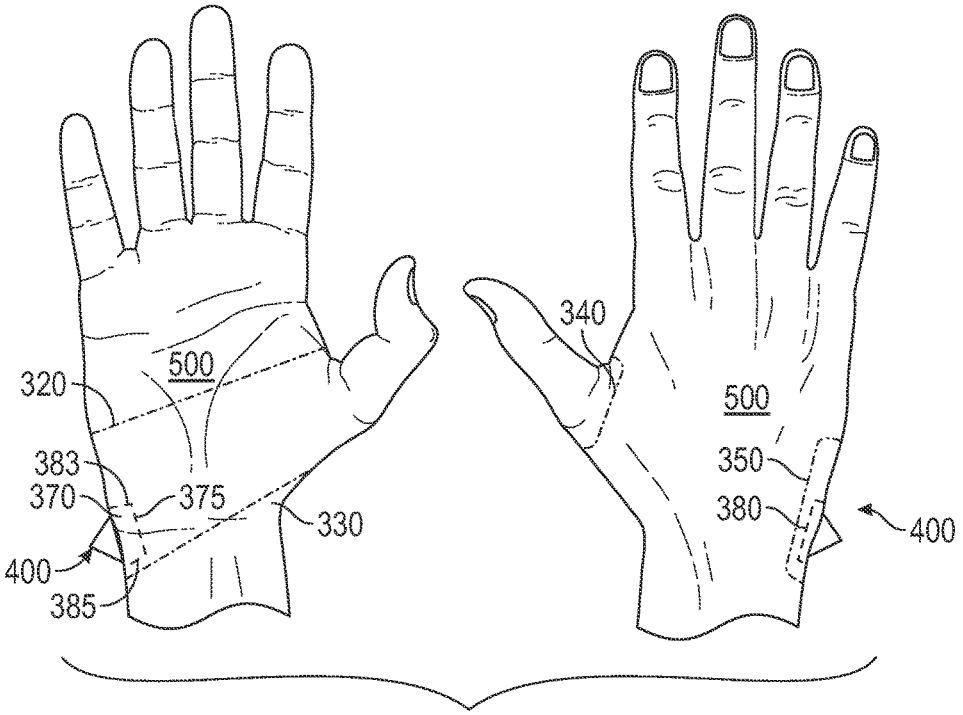
FIG. 1 depicts areas upon a hand where a disclosed wrist hooking system or protrusions may protrude

200 inner padding system
300 outer glove system
320 upper horizontal seam
330 lower horizontal seam
340 thumb wrapping seam
350 protrusion wrapping seam
370 protrusion base
375 inner vertical edge of protrusion base 370
380 outer vertical edge of protrusion base 370
383 upper horizontal edge of protrusion base 270
385 lower horizontal edge of protrusion base 270
400 areas of protrusion upon a glove or hand
500 hand or hands
600 Olympic rings or similar implements
700 cylindrical protrusions or levers
710 circular side walls of cylindrical protrusions
720 circular top shelf of cylindrical protrusions
800 wedge or wedge hooking system
810 lower inner surface of wedge 800
815 knuckle edge of lower inner surface 810
820 thumb edge of lower inner surface 810
825 wrist edge of lower inner surface
830 fold line between lower inner surface 810 and raised hooking surface 840
835 bevel edge of lower inner surface 810
837 lower base wall of lower inner surface 810
839 depth of wedge at the lower inner surface 810
840 raised hooking surface
845 knuckle edge of raised hooking surface 840
850 outer edge of raised hooking surface 840
855 wrist edge of raised hooking surface 840
860 depth of wedge at raised hooking surface 840
865 angle between lower inner surface 810 and raised hooking surface 840
900 palm traction system
910 rail guide section of palm traction section 900
920 base section of palm traction section 900

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

Any and all the above references and U.S. patents and applications are incorporated herein by reference. Aspects of the invention can be modified, if necessary, to employ the systems, functions and concepts of the various patents and applications described above to provide yet further embodiments of the invention.

FIG. 1 depicts hands 500 and areas of protrusion 400 for various disclosed hooking systems. Areas of protrusion 400 may be located upon or near the lower palm area of a hand and such areas may be upon or near the hypothenar muscles. Areas of protrusion 400 may also be located in the mid to upper palm edge. The areas of protrusion 400 may also be located upon, between or near the small joints of the little finger such as the carpometacarpal and/or metacarpophalangeal. Areas of protrusion 400 may also be located at or near the wrist area or higher upon the mid to upper palm edge. Areas of protrusion may be referred to as the palm edge area of a glove or hand.

FIG. 1 also depicts seam systems sometimes used to secure protrusions upon or into a glove. A disclosed seam system may comprise an upper horizontal seam 320, a lower horizontal seam 330, a thumb seam 340 and a protrusion wrapping seam 350. The thumb seam 340 may wrap around the back side of the hand and thumb. Placing the thumb seam 340 around the back side of the hand and thumb portions of the glove provides superior means of attachment of protrusions or disclosed levers. A seam around the thumb prevents rotation and dislodgement of attached protrusions or disclosed levers. A thumb seam 340 also helps to dissipate strain and pressure upon a greater surface area of the hand. As mentioned above, the various ring exercises present significant hand strain to an athlete.

The protrusion wrapping seam 350 may be found upon or near the palm edge or back side of the glove. Such placement of the protrusion wrapping seam allows the palm edge of the hand to further dissipate strain resulting from ring exercises.

FIG. 1 further depicts a protrusion base 370. Disclosed protrusions, such as cylindrical protrusions (shown on FIG. 7) may be secured upon or integrated into a protrusion base 370 which may comprise an inner vertical edge 375, upper horizontal edge 383, a lower horizontal edge 385 and an outer vertical edge 380. The outer vertical edge 380 may be found upon the back side of the glove, (shown on the backside of a hand, in FIG. 1) While the disclosed seam system and protrusion base are part of a disclosed glove system, the two systems are illustrated upon bare hands for purposes of clarity. A protrusion base 370 may comprise a solid component integrated into a cylindrical protrusion or other disclosed lever. A protrusion base 370 may comprise a flange component integrated into a disclosed lever.

Figure 2A:
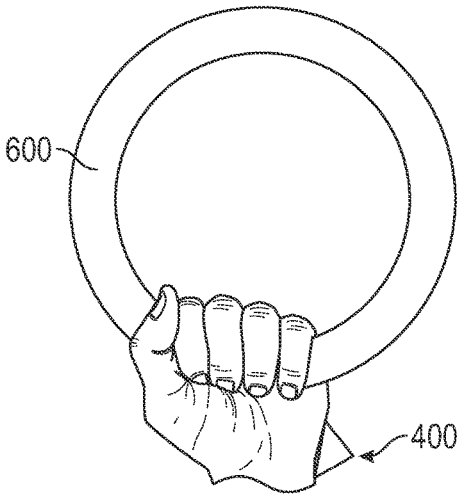
FIG. 2A depicts a hand in a normal grip or hanging grip position

FIG. 2A depicts a bare hand grasping an Olympic ring 600 in a normal or hanging position. A protrusion area 400 is shown upon a bare hand to more clearly illustrate a disclosed protrusion area 400, even though the disclosed embodiments attach levers or protrusion implements upon a glove, in the glove's protrusion area 400.

Figure 2B:
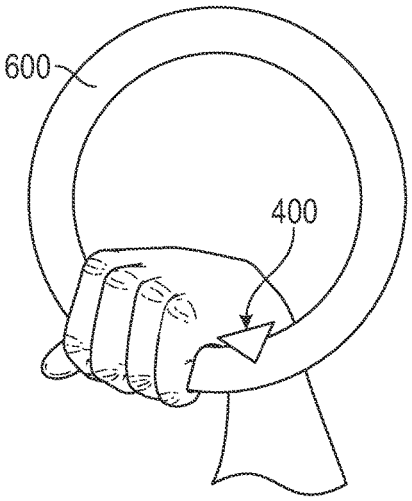
FIG. 2B depicts a hand in a false grip position

FIG. 2B depicts a bare hand grasping an Olympic ring 600 is a false grip position. The protrusion area 400 is illustrated in a position on top of an inner surface of the Olympic ring. In this false grip position, a disclosed protrusion or lever provides leverage in gripping the ring and dissipates hand strain caused by the grip. In a false grip position, a disclosed protrusion or lever may hook upon the ring to assist the athlete in maintaining the grip.

Figure 3:
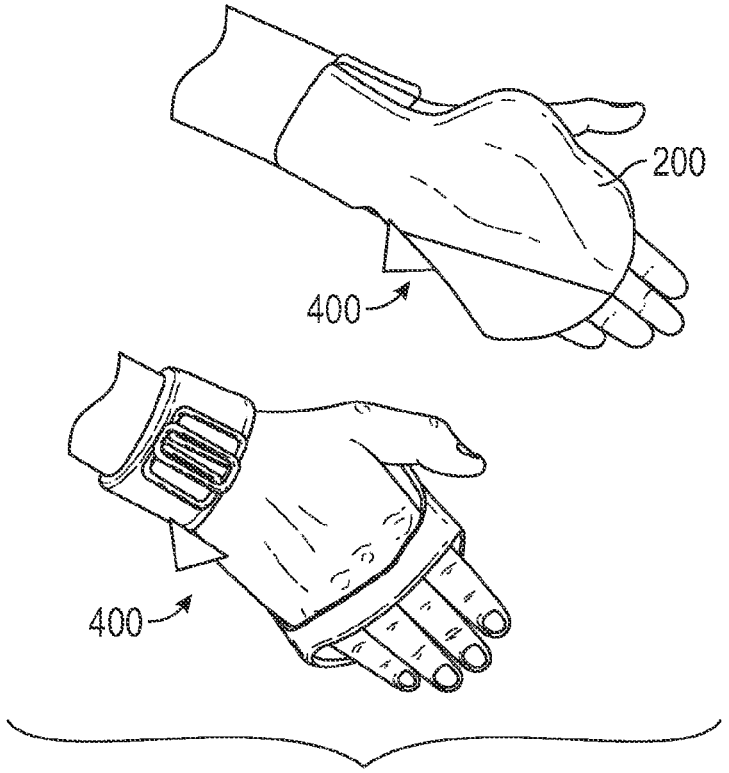
FIG. 3 depicts two hands, a pad system and areas where a disclosed wrist hooking system or protrusions may protrude

FIG. 3 depicts a disclosed inner padding system 200 that may include a protrusion area 400 used in a manner similar to the other disclosed embodiments.

Figure 4:
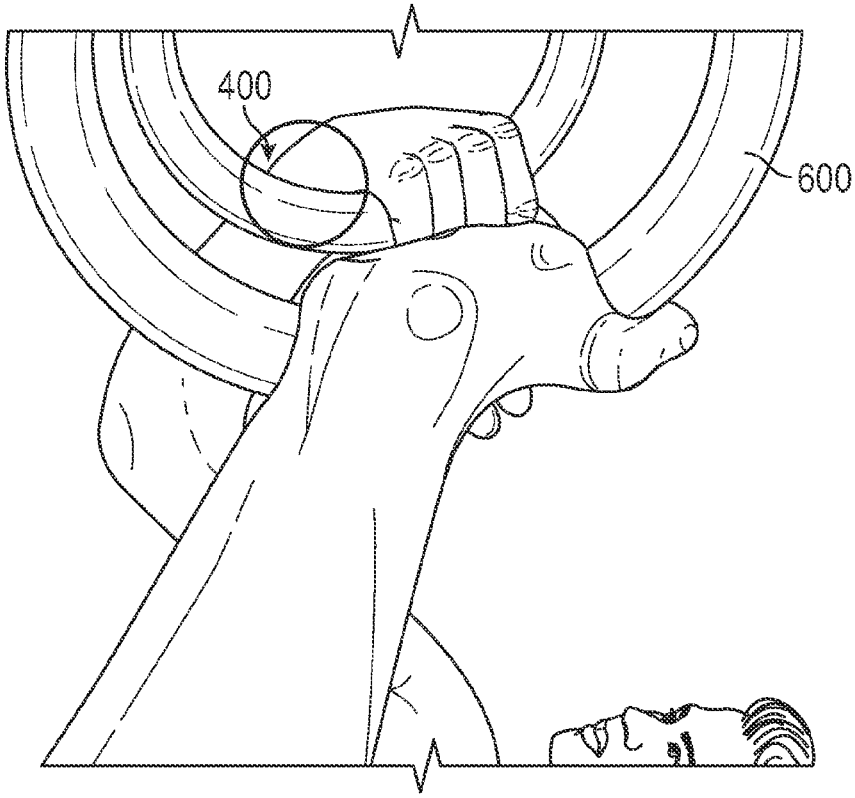
FIG. 4 depicts hands or wrist areas upon a rings and areas where a disclosed wrist hooking system may protrude

FIG. 4 depicts hands in a false grip position and an area of protrusion 400.

Figure 5:
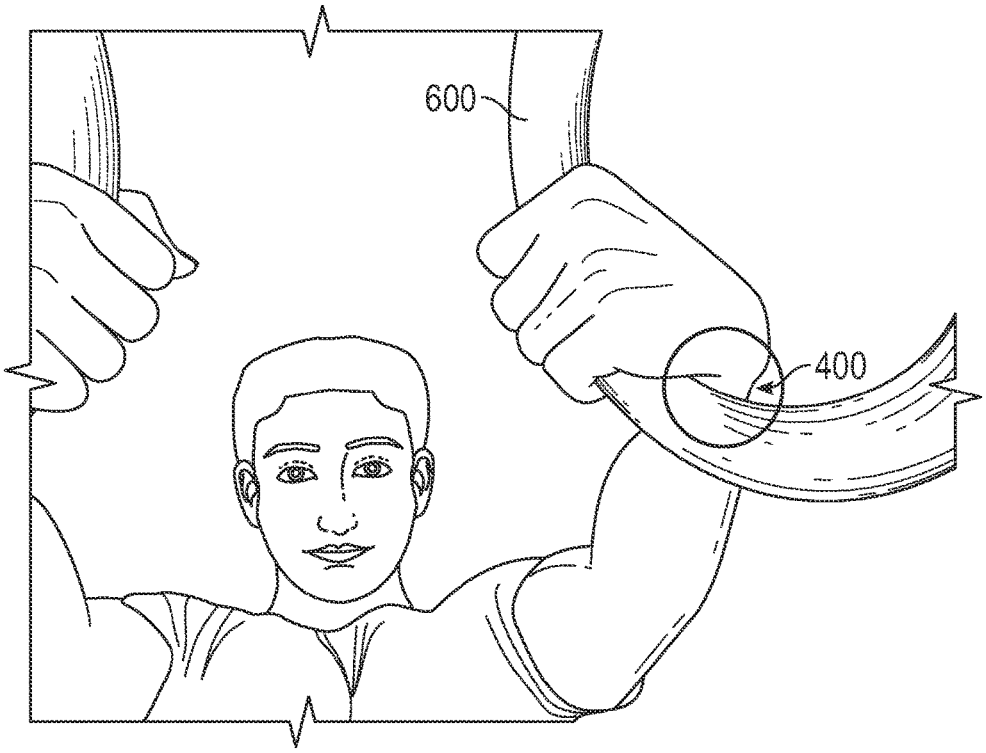
FIG. 5 depicts a hand or wrist area in relation to a ring and depicts an area where a disclosed wrist hooking system or protrusions may protrude

FIG. 5 depicts a false grip upon Olympic rings 600 and an area of protrusion.

Figure 6:
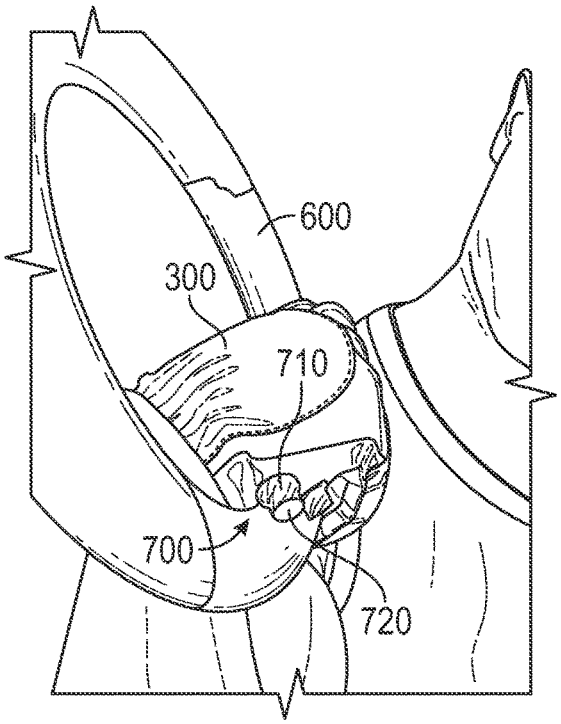
FIG. 6 depicts a disclosed embodiment used in a false grip position

FIG. 6 depicts two cylindrical protrusions or levers 700 attached to or integrated with a disclosed glove 300. The cylindrical protrusions 700 overcome shortfalls in the art by providing a frim lever to assist in maintaining the false grip and to assist in further maneuvers such as the muscle up and iron cross. The round edges or circular side walls 710 of the cylindrical protrusions 700 add to the versatility of the embodiment as a hand rotates upon the ring, contact is smoothly maintained with the cylindrical protrusions 700. The cylindrical protrusions have curved side walls 710 and a circular top shelf 720. The artful combination of the circular side walls 710 and circular top shelf 720 make the cylindrical protrusions 700 useful as leverage is provided in any hand orientation upon the ring and off the ring, the cylindrical protrusions do not interfere with other gym related exercises.

Figure 7:
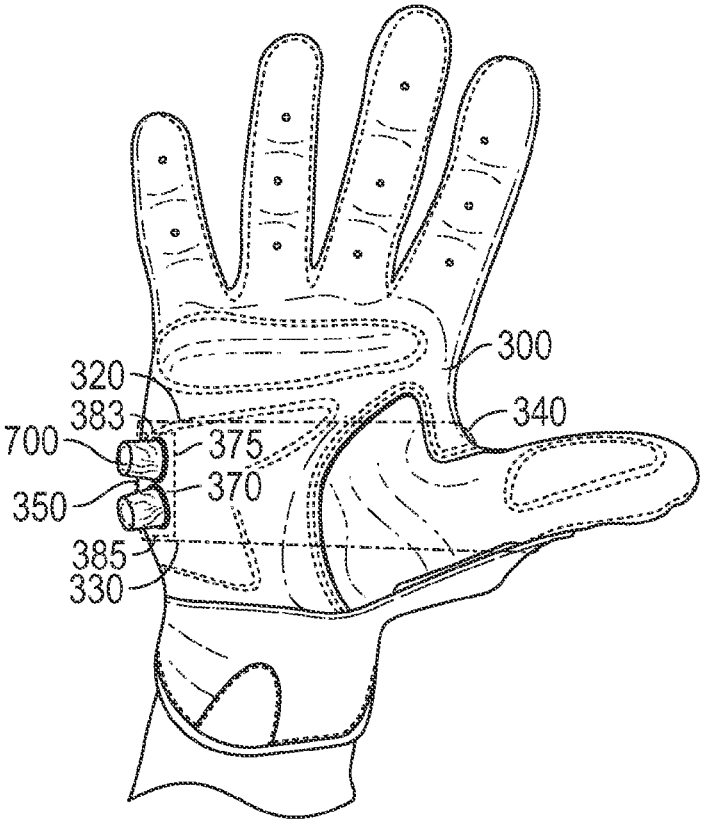
FIG. 7 depicts a disclosed hooking system

FIG. 7 depicts cylindrical protrusions 700 integrated into a glove 300 by use of an artful seam system, the seam system comprising a lower horizontal seam 330 attached to a protrusion wrapping seam 350, the protrusion wrapping seam attached to an upper horizontal seam 320, the upper horizontal seam attached to a thumb wrapping seam 340. The disclosed seam systems prevent a protrusion or wedge from rotating around the outside of a hand and losing leverage while using rings FIG. 7 further depicts an optional protrusion base 370 having four or so edges or seams comprising an inner vertical edge 375, lower horizontal edge 385, an upper horizontal edge 383 and as shown in FIG. 1, and an outer vertical edge 380.

Figure 8:
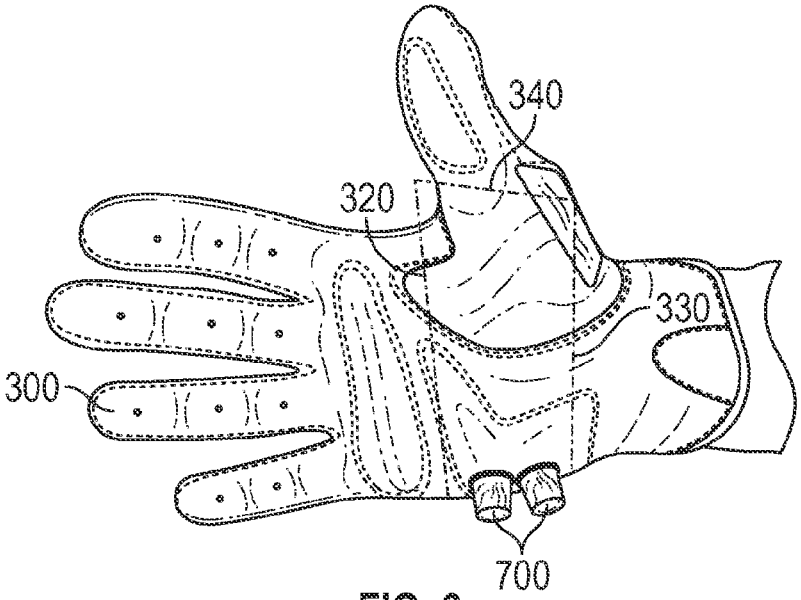
FIG. 8 depicts a disclosed hooking system integrated or incorporated into a glove

FIG. 8 depicts glove 300 with a contained or integrated hooking system, such as cylindrical protrusions 700. The seam system securing the hooking system may comprise a thumb wrapping seam 340 located upon or within the palm side or back side of the glove 300. The thumb wrapping seam may be placed around the thumb on the back side of the hand or may be positioned upon the palm. A glove may comprise a front or palm side, back side, palm edge area and thumb piece.

Figure 9:
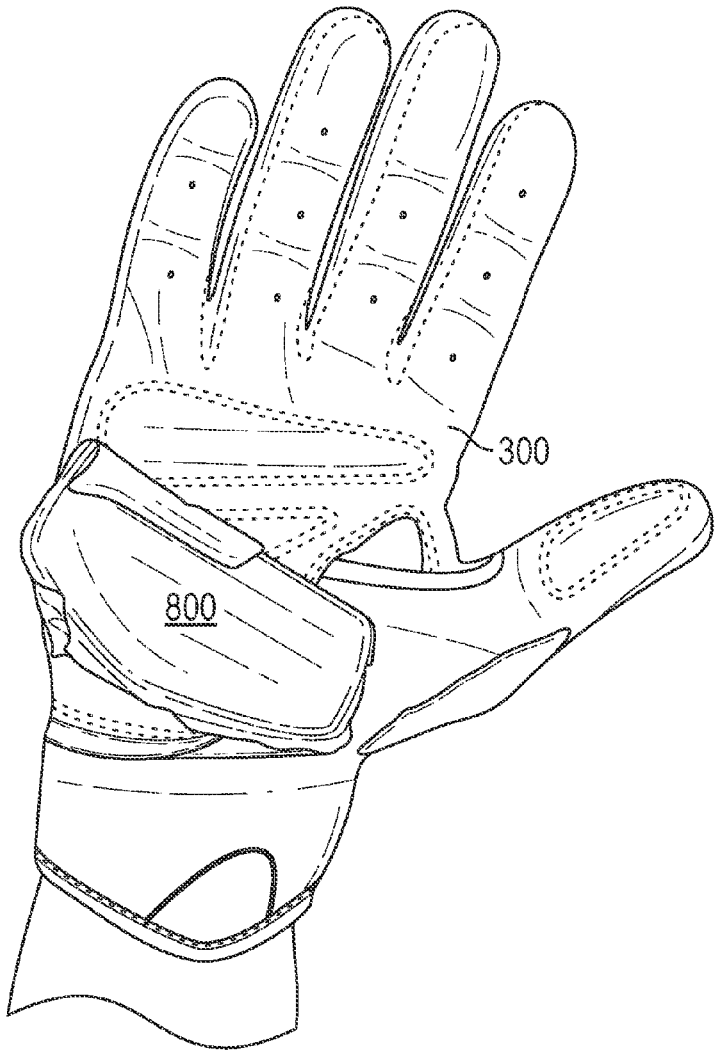
FIG. 9 depicts a hooking lever or wedge system integrated into a glove

FIG. 9 depicts glove 300 integrated with a wedge 800 or wedge hooking system. The wedge 800 may have two planar surfaces or one curved outer surface useful in hooking or attaching to a ring. The wedge 800 overcomes shortfalls in the art by providing greater surface area to hook upon a ring and to dissipate ring pressure applied to a hand. The embodiment of FIG. 9 is sometimes referred to as a wrist hooking lever glove and overcomes shortfalls in the art by providing a great deal of leverage to assist beginners who struggle with the false grip.

Figure 10:
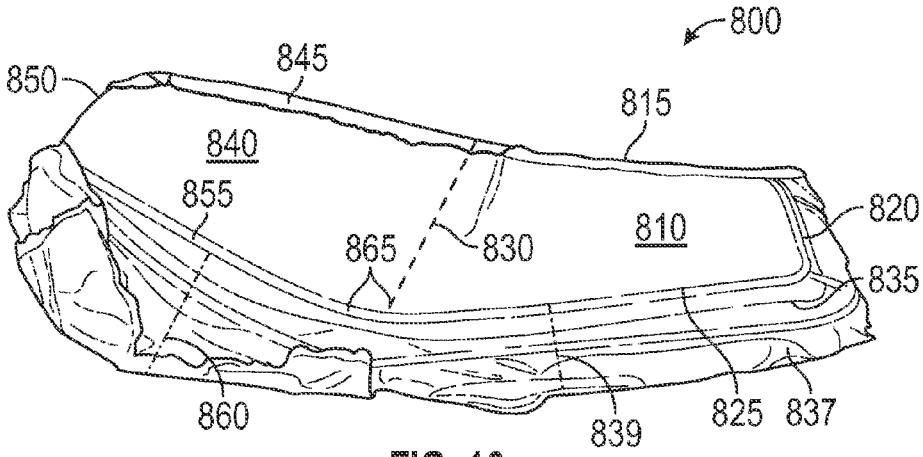
FIG. 10 depicts a hooking system or hooking lever

FIG. 10 depicts a more detailed view of a wedge 800 which may comprise a single curved outer surface providing leverage and friction upon a ring. A curved outer surface may be described or comprised of a lower inner surface 810 attached to a raised hooking surface 840. A fold line 830 or transition line 830 may attach to the lower inner surface 810 and raised hooking surface 840. There may be an angle 865 between the lower inner surface 810 and the raised hoking surface 840, the angle 865 may be in the range of five to sixty degrees. The angle 865 between the lower inner surface 810 and the raised hoking surface 840 may be achieved or maintained by a differential between the depths of the wedge 839 at the lower inner surface 810 as compared to the depth of the wedge 855 at the raised hooking surface 840. The increased wedge depth at the raised hooking surface provides a resiliency helpful in damping hand trauma during ring exercises.

A wedge 800 may comprise a lower inner surface 810 comprising or defined by a thumb edge 820 connected to a knuckle edge 815 and a wrist edge 825 with the wrist edge and knuckle edge connected to a fold line 830. The outer edges of the inner surface may comprise a bevel edge 835 connected to a lower base wall 810. The bevel edge 835 and lower base wall 810 combination help to further dissipate hand strain. The wedge may have a back side, not shown that terminates at the lower section of the lower base wall 810.

A wedge may further comprise a raised hooking surface 840 contiguous to or attached to the lower inner wedge 810. The three outer sides of a raised hooking surface may comprise a outer edge 850 attached to a knuckle edge 845 and wrist edge 855 with the outer edge 850 and wrist edge 845 attached to the fold line 830.

Figure 11:
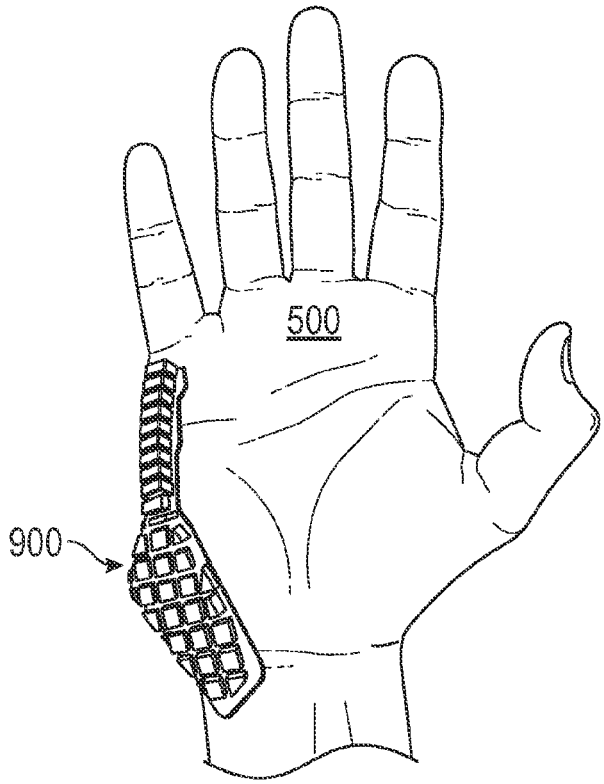
FIG. 11 depicts an outside palm traction system

FIG. 11 depicts a palm traction system 900 used or attached upon a glove but illustrated upon a hand 500. This embodiment is sometimes called an outside palm traction system and assists with reducing hand strain and performing ring exercises.

Figure 12:
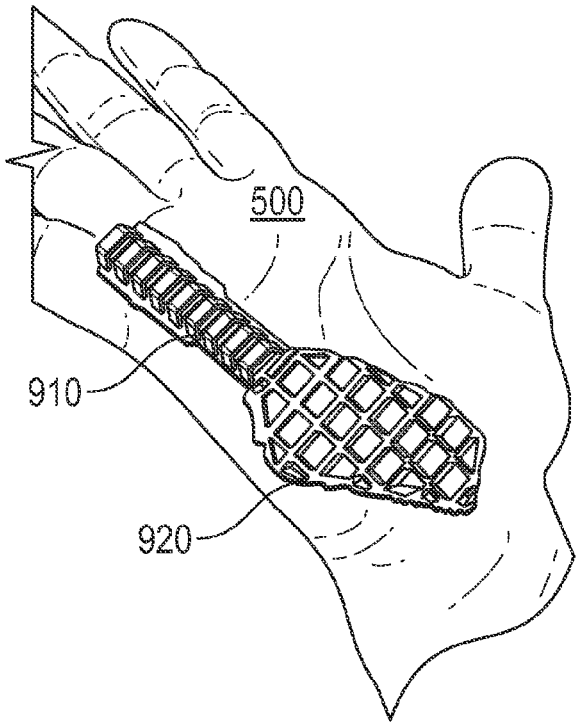
FIG. 12 depicts an outside palm traction system

FIG. 12 depicts a palm traction system 900 comprising a rail guide section 910 attached to a base section 820.

Items

Disclosed embodiments may include the following items.

1. A system for assisting athletes in reaching and maintaining a false grip upon a ring, the system comprising:
   a) a glove 300 comprising a palm side, palm edge area 400, back side and thumb piece;
   b) a protrusion 700 secured to the glove within the palm edge area of the glove;
   c) the protrusion comprising cylinder side walls 710 attached to a circular top shelf;
   d) the protrusion secured to the glove by a seam system, the seam system comprising a lower horizontal seam 330 attached to a thumb wrapping seam 340, the thumb wrapping seam attached to a upper horizontal seam 320 and the upper horizontal seam attached to a protrusion wrapping seam 350, the protrusion wrapping seam located upon the back side of the glove and the thumb wrapping seam spanning a back side of the thumb piece.

2. The system of item 1 comprising two or more protrusions secured to the glove.

3. The system of item 1 further comprising a protrusion base 370 attached to the protrusion and attached to the seam system.

4. The system of item 3 wherein the protrusion base comprises a inner vertical edge 375 attached to a upper horizontal edge 383 and a lower horizontal edge 385 with an outer vertical edge 380 attached to the upper horizontal edge and the lower horizontal edge.

5. The system of item 4 wherein the outer vertical edge is attached to the back side of the glove and the upper horizontal edge, lower horizontal edge and inner vertical edge are secured to palm side of the glove.

6. The system of item 1 wherein the protrusion comprises a wedge 800, the secured to a mid to upper palm area of the glove, the wedge comprising:

a) a lower inner surface 810 comprising a knuckle edge 815, a thumb edge 820, a wrist edge 825 and a fold line 830, the lower inner surface attached to a bevel edge 835 and the bevel edge 835 attached to a lower base wall 837, the lower inner surface comprising a first depth 839 between a back side of the lower inner surface and the lower inner surface;

b) a raised hooking surface attached to the lower inner surface, the raised hooking surface comprising a knuckle edge 845, an outer edge 850, a wrist edge 855 and sharing the fold line with the lower inner surface, the raised hooking surface having an angle 865 with the lower inner surface in the range of five to forty-five degrees.

7. The system of item 6 wherein the raised hooking surface has a second depth 855 between a back side of the raised hooking surface and the raised hooking surface, the second depth of the raised hooking surface being at least one third larger than the first depth of the lower inner surface.

8. The system of item 1 wherein the protrusion comprises palm traction system attached to the glove, and the palm traction system comprises a rail guide attached to a base section.

What is claimed is:

1. A system for assisting athletes in reaching and maintaining a false grip upon a ring, the system comprising:

a glove comprising a palm side, palm edge area, back side and thumb piece;

a protrusion;

the protrusion comprising cylinder side walls attached to a circular top shelf;

the protrusion secured to the glove surface within the palm edge area of the glove by a seam system, the seam system comprising;

a lower horizontal seam, a thumb encircling seam, an upper horizontal seam, a protrusion wrapping seam, wherein;

the thumb wrapping seam intersects with a upper horizontal seam, and the upper horizontal seam intersects with the protrusion wrapping seam, the protrusion wrapping seam located upon the back side of the glove and the thumb wrapping seam spanning a back side of the thumb piece.

2. The system of claim 1, comprising two or more protrusions secured to the glove.

3. The system of claim 1, further comprising a protrusion base attached to the protrusion and attached to the seam system.

4. The system of claim 1, wherein the protrusion base comprises an inner vertical edge attached to a upper horizontal edge and a lower horizontal edge with an outer vertical edge attached to the upper horizontal edge and the lower horizontal edge.

5. The system of claim 1, wherein the outer vertical edge is attached to the back side of the glove and the upper horizontal edge, lower horizontal edge and inner vertical edge are secured to palm side of the glove.

* * * * *